US006411034B1

(12) United States Patent
Cho et al.

(10) Patent No.: US 6,411,034 B1
(45) Date of Patent: Jun. 25, 2002

(54) PLASMA DISPLAY PANEL HAVING A GAS FLUSHING SYSTEM

(75) Inventors: Jong-ho Cho, Kwachun; Noc-koo Kim, Chunan, both of (KR)

(73) Assignee: Samsung SDI Co., Ltd., Kyungki-do (KR)

( * ) Notice: Subject to any disclaimer, the term of this patent is extended or adjusted under 35 U.S.C. 154(b) by 0 days.

(21) Appl. No.: 09/353,771

(22) Filed: Jul. 15, 1999

(30) Foreign Application Priority Data

Feb. 27, 1999 (KR) ..... 99-6639

(51) Int. Cl.[7] ..... H01J 17/49

(52) U.S. Cl. ..... 313/584; 313/582; 313/493; 313/586; 313/609

(58) Field of Search ..... 313/582, 493, 313/584, 609, 586

(56) References Cited

U.S. PATENT DOCUMENTS 6,236,159 B1 * 5/2001 Inoue et al. ..... 313/582

FOREIGN PATENT DOCUMENTS

JP 61-216225 9/1986

* cited by examiner

*Primary Examiner*—Vip Patel
*Assistant Examiner*—Ken A Berck
(74) *Attorney, Agent, or Firm*—Lowe Hauptman Gilman & Berner, LLP

(57) ABSTRACT

A plasma display including a rear substrate having a picture display area including partitions arranged in parallel, address electrodes between the partitions and a phosphor layer deposited over the address electrodes; a front substrate having electrodes formed on the bottom surface thereof to cross the address electrodes, and sealed with the rear substrate by an adhesive on the edges of the substrates; an inlet and an outlet formed in the rear substrate, through which a flushing gas flows into and out of the display, respectively; and at least one path block for blocking flow of the flushing gas along paths nearest to the edges, such that the flushing gas flowed in through the inlet flows along the paths between the partitions to exit via the outlet.

7 Claims, 4 Drawing Sheets

PLASMA DISPLAY PANEL HAVING A GAS FLUSHING SYSTEM

BACKGROUND OF THE INVENTION

1. Field of the Invention

The present invention relates to a plasma display, and more particularly, to a plasma display having an enhanced structure to completely remove impurity gas generated during manufacture of a display from a display housing.

2. Description of the Related Art

Flat display devices such as liquid crystal display (LCD), plasma display panel (PDP) or field emission display (FED) are thin and lightweight and consume a small amount of power, so it is gradually replacing a conventional cathode ray as a display device.

The plasma display forms discharge space, i.e., discharge cells, between a pair of substrates, to display a picture, and each discharge cell is separated by partitions which prevent crosstalk between the discharge cells.

FIG. 1 shows an example of a conventional alternating current (AC) type plasma display. Referring to FIG. 1, address electrodes 11 and partitions 13 are formed in parallel on a rear substrate 20 and a phosphor layer 12 is deposited over the address electrodes 11.

The partitions 13 keep a discharge distance and prevent an optical crosstalk between the discharge cells.

Generally, the partitions 13 have been formed by squeezing process using a dispenser and a needle. Also, the partitions 13 may be formed by a printing process in which a partition material is printed using a screen having a predetermined pattern and then cured repetitively, or by photolithography process.

Sustaining electrodes 15*a* are formed on the bottom surface of a front substrate 10, intersecting the address electrodes 11 of the rear substrate 20. Also, the sustaining electrodes 15*a* may have bus electrodes 15*b* for reducing line resistance. The electrodes 15*a* and 15*b* are covered with a dielectric layer 17 formed on the bottom surface of the front substrate 10.

The rear substrate 20 and the front substrate 10 are sealed by an adhesive, e.g., frit, deposited at the borders thereof.

After assembly of a plasma display is completed, impurities and impurity gas generated during manufacture remains in the plasma display, which degrades a discharge characteristic of the display, thereby lowering the performance. Accordingly, after the assembly of the plasma display, flushing gas is injected into the display via an inlet $H_i$ and then forcibly exhausted via an outlet $H_o$. During this process, the internal impurities and impurity gas are removed together with the flushing gas. Such method for eliminating the impurities using a flushing gas is called a gas flushing method.

Here, flow paths of the flushing gas by the edges A, B and C of the display (as indicated by relatively large arrows) are wider than flow paths D between the partitions 13 (as indicated by small arrows), so that most flushing gas introduced into the display through the inlet $H_i$ flows in the paths by the edges A, B and C. Removing the remaining impurities or gas from an actual image display area of the display is not sufficient. As a result, some impurities in the actual image display area are not completely removed.

SUMMARY OF THE INVENTION

To solve the above problems, it is an object of the present invention to provide a plasma display comprising a path block, capable of efficiently removing impurities and gas remaining in a display, which are generated during manufacture of the display.

To achieve the above object, there is provided a plasma display comprising: a rear substrate having a picture display area including partitions arranged in parallel, address electrodes formed between the partitions and a phosphor layer deposited over the address electrodes; a front substrate having electrodes formed on the bottom surface thereof to cross the address electrodes, to be sealed with the rear substrate by an adhesive on the edge; an inlet and an outlet formed in the rear substrate, through which a flushing gas flows into and out of the display, respectively; and at least one path block for blocking flow of the flushing gas along the path adjacent to the outermost partition, such that the flushing gas injected in through the inlet mostly flows along the paths between the partitions and exists via the outlet.

Preferably, the plasma display further comprises a guide wall for enclosing the picture display area, the inlet, the outlet and the blocks.

Preferably, the inlet and the outlet are formed in the rear substrate, facing each other in a diagonal direction.

BRIEF DESCRIPTION OF THE DRAWINGS

The above object and advantages of the present invention will become more to apparent by describing in detail a preferred embodiment thereof with reference to the attached drawings in which.

DESCRIPTION OF THE PREFERRED EMBODIMENT

Figures 1, 1A:
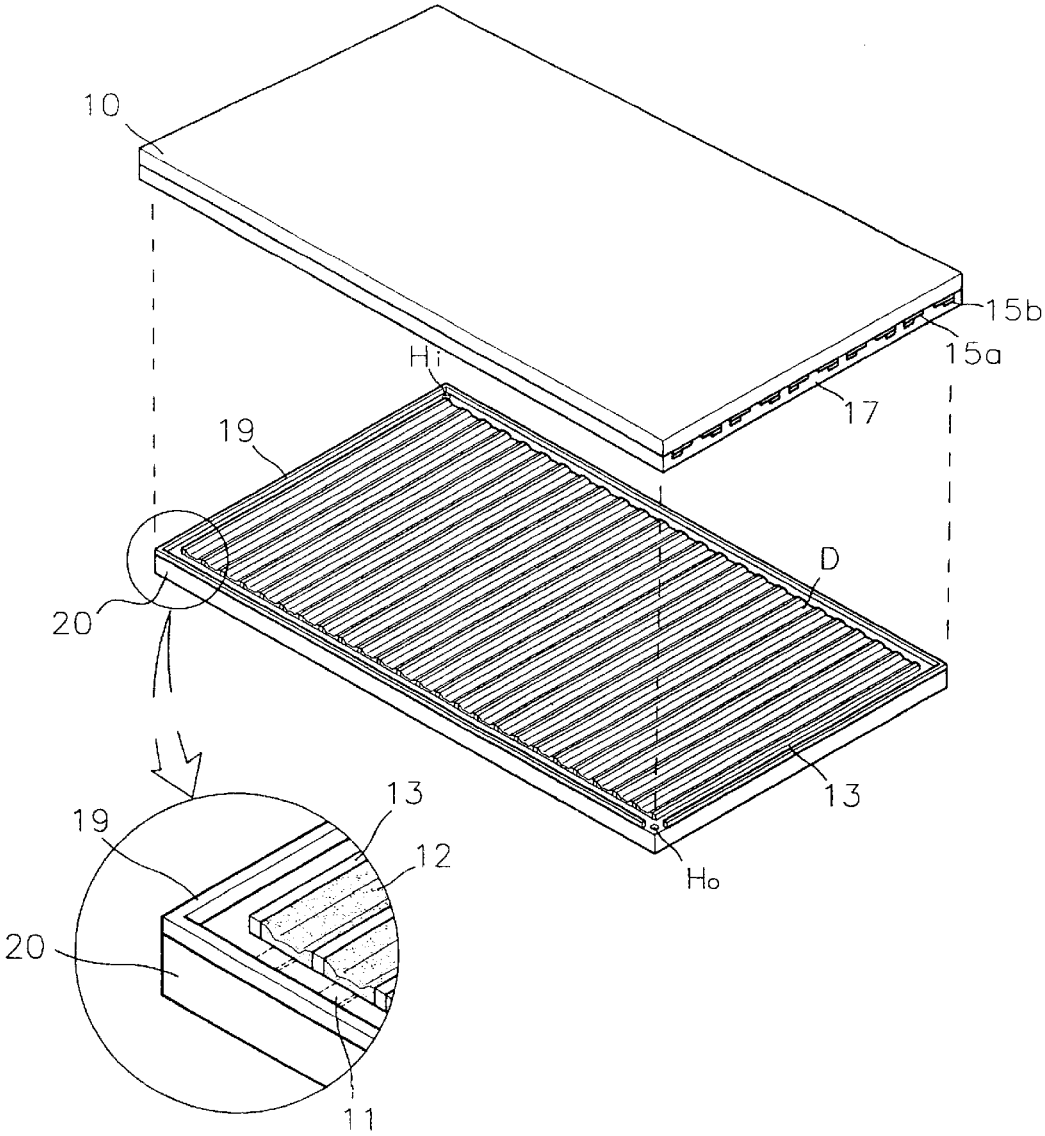
FIG. 1 (PRIOR ART)
FIG. 1A (PRIOR ART)
FIG. 1 is an exploded perspective view of a conventional plasma display.
Figure 2:
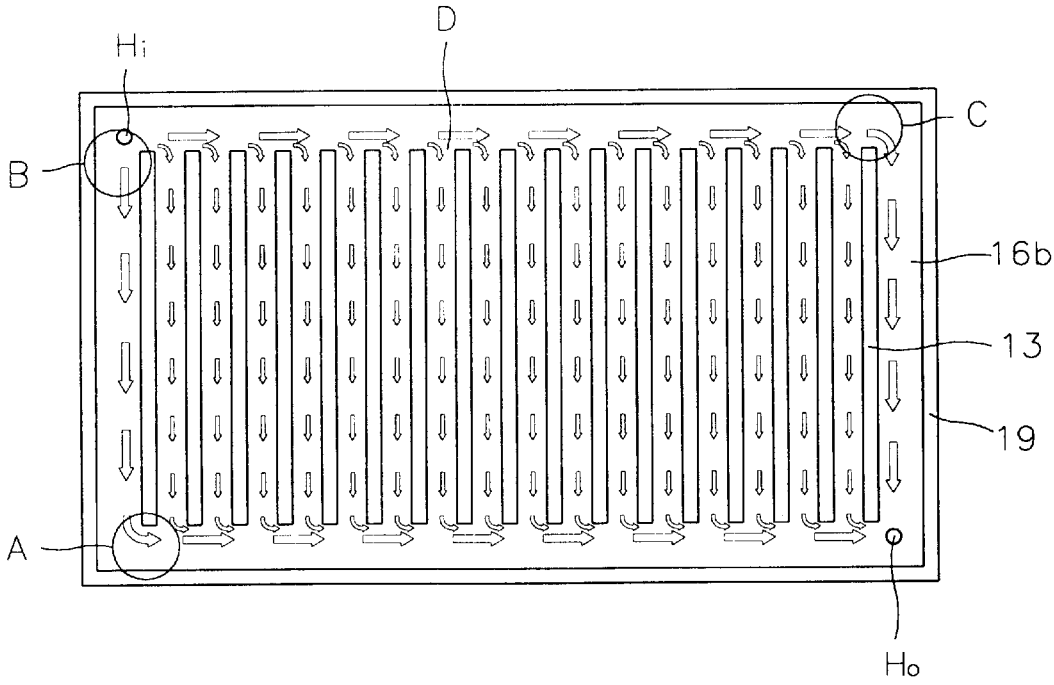
FIG. 2 (PRIOR ART)
FIG. 2 is a plan view showing the structure of the rear substrate and arrangement of the partitions shown in FIG. 1.

A plasma display according to a preferred embodiment of the present invention will be described with reference to FIGS. 3 and 4. Here, the same reference numerals as in FIGS. 1 and 2 represent the same elements.

Figure 3:
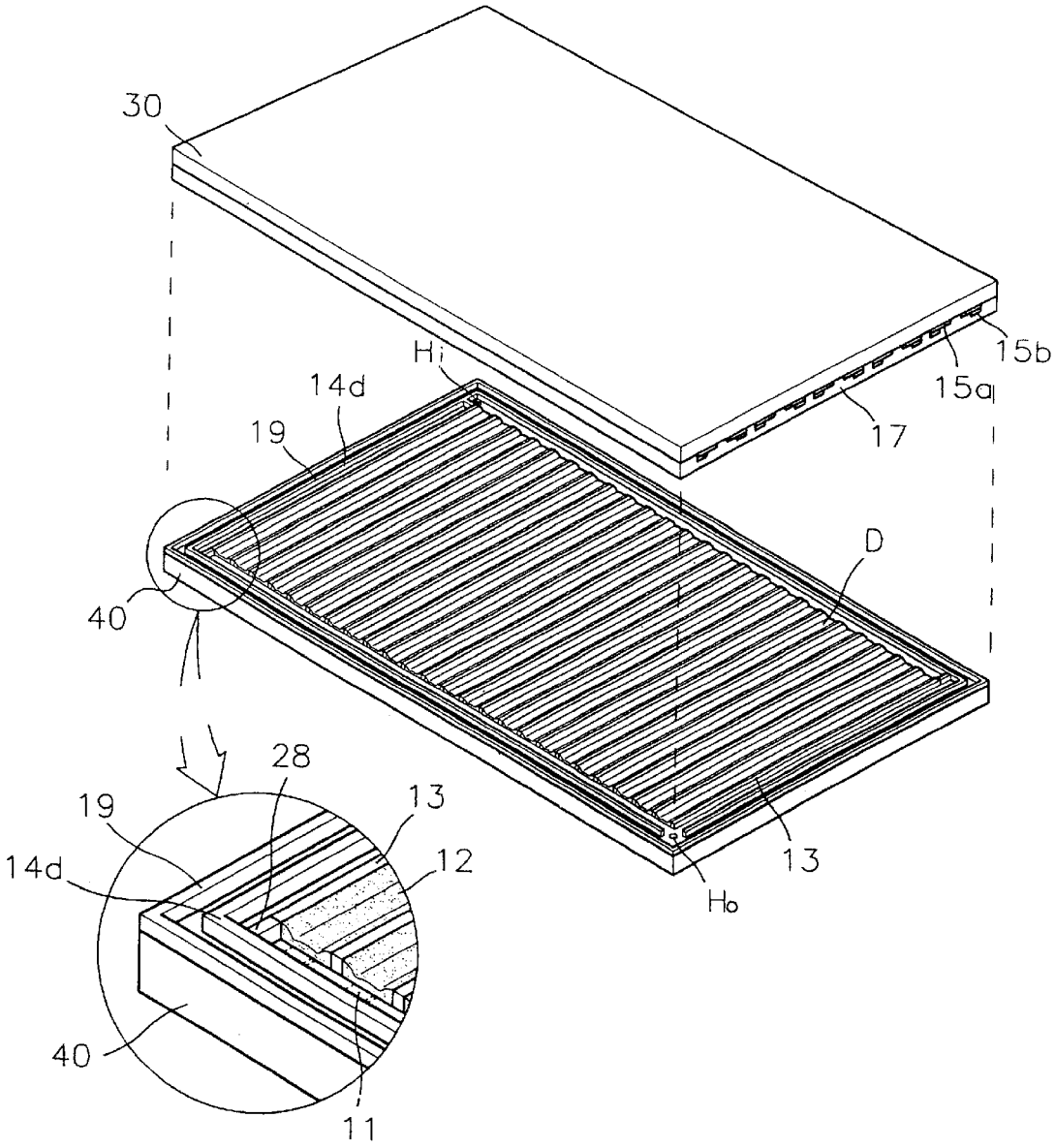
FIG. 3 is an exploded perspective view of a plasma display according to the present invention.
Figure 4:
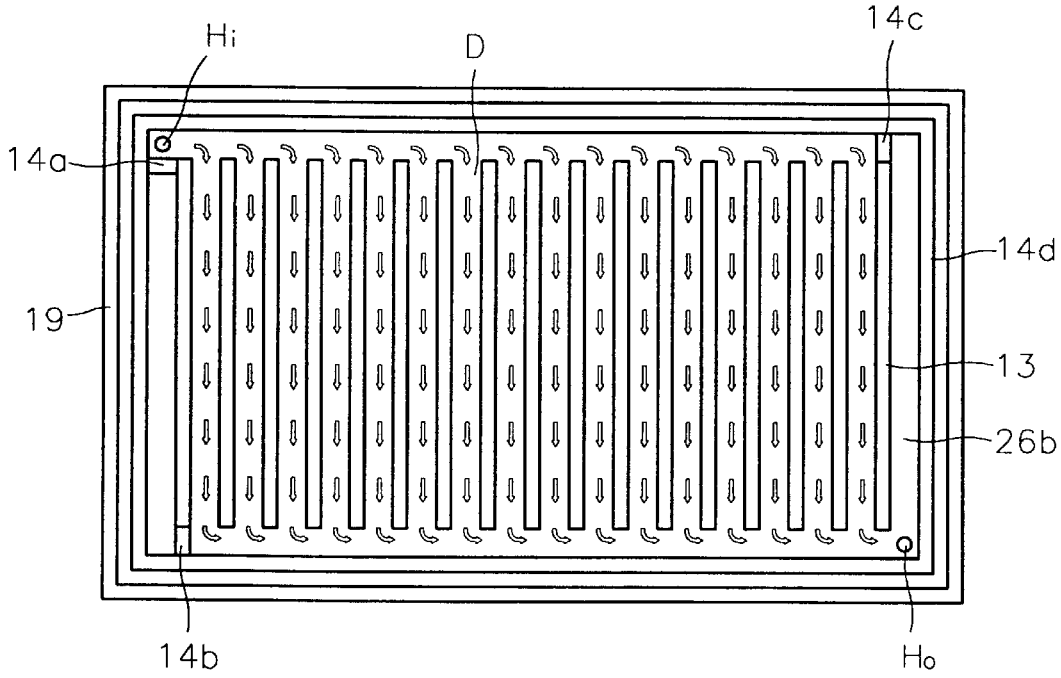
FIG. 4 is a plan view showing the structure of the rear substrate and arrangement of the partitions shown in FIG. 3.

As shown in FIG. 3, a front substrate 30 and a rear substrate 40 are sealed to each other by an adhesive 19 such as a frit.

According to the present invention, a guide wall 14*d* for guiding flow of a flushing gas is formed to be spaced by a predetermined distance inwardly from the edge of the substrate on which the adhesive 19 is deposited.

The guide wall 14*d* is formed to surround a picture display area of the display. Also, an inlet $H_i$ and an outlet $H_o$ via which a flushing gas flows into and out of the display respectively are formed inside the guide wall 14*d* in the rear substrate 40, facing each other in a diagonal direction.

According to the characteristics of the present invention, at least one path block 14*a*, 14*b* or 14*c* for blocking the gas flow along the edge of the display are installed such that the flushing gas flowed into the display through the inlet $H_i$ cannot flow along the edge of the picture display area. Referring to FIG. 4, the blocks 14*a* and 14*b* block the edge flow path adjacent to the outermost partition 13 to prevent the flushing gas flowed through the inlet $H_i$ from flowing along the edge of the picture display area. Thus, the flushing gas is made to flow along paths D between the partitions 13. Here, the positions of the blocks 14*a*, 14*b* and 14*c* may be changed properly if required.

Preferably, the guide wall 14*d* and the blocks 14*a*, 14*b* and 14*c* are formed of the same material as that for the partitions 13.

When assembly of the plasma display having the above structure according to the present invention is completed and then a flushing gas is flowed into the display through the inlet $H_i$, the flushing gas flows only along the paths between the partitions 13, not along the edges of the picture display area, so that the impurities or gas remaining in the picture display area can more efficiently be removed. Also, because the gas flow is smooth, the amount of flushing gas required is reduced and the time required for exhausting the impurities or gas is also shortened.

While the present invention has been illustrated and described with reference to a specific embodiment, further modifications and alterations within the spirit and scope of this invention as defined by the appended claims will become evident to those skilled in the art.

What is claimed is:

1. A plasma display, comprising:

a first substrate having a picture display area including partitions arranged in parallel, and first electrodes;

a second substrate having second electrodes formed transverse to the first electrodes, and being sealed with the first substrate by a sealing member positioned in peripheral portions of the substrates;

a guide wall extending circumferentially of the substrates and in inwardly spaced relation to said sealing member, said guide wall surrounding said partitions and defining together with said partitions a plurality of parallel passages including side passages formed between said guide wall and the outermost ones of said partitions, and main passages formed between adjacent said partitions;

an inlet and an outlet formed in the first substrate, through which, during manufacture of the display, a flushing gas flows into and out of the display, respectively; and at least one path block for blocking the flushing gas from entering at least one of the side passages so that the flushing gas enters the display through the inlet, flows along the main passages between the partitions, and exits via the outlet.

2. The plasma display of claim 1, wherein the inlet and the outlet are formed in opposite corners of the first substrate, facing each other in a diagonal direction.

3. The plasma display of claim 1, wherein said at least one side passage is completely sealed off from the flushing gas.

4. The plasma display of claim 1, wherein the first and second substrates are rear and front substrates of the display, respectively.

5. The plasma display of claim 1, wherein the first electrodes are address electrodes and arranged between said partitions.

6. The plasma display of claim 5, further comprising a phosphor layer deposited over the address electrodes.

7. The plasma display of claim 4, wherein the second electrodes are formed on a bottom surface of the front substrate.

* * * * *